US005426956A

United States Patent [19]

Phillippe

[11] Patent Number: 5,426,956

[45] Date of Patent: Jun. 27, 1995

[54] REFRIGERANT SYSTEM EFFICIENCY AMPLIFYING APPARATUS

[76] Inventor: Gary E. Phillippe, 7263 Larchmont Dr., North Highlands, Calif. 95660

[21] Appl. No.: 148,008

[22] Filed: Nov. 4, 1993

[51] Int. Cl.[6] ..... F25B 39/04

[52] U.S. Cl. ..... 62/509; 62/511

[58] Field of Search ..... 62/509, 511, 527

[56] References Cited

U.S. PATENT DOCUMENTS

| | | | |
|---|---|---|---|
| 2,278,001 | 3/1942 | Thompson | 62/509 X |
| 4,773,234 | 9/1988 | Kann | 62/509 X |
| 4,807,449 | 2/1989 | Helmer | 62/509 X |
| 5,159,821 | 11/1992 | Nakamura | 62/509 |

FOREIGN PATENT DOCUMENTS

| | | | |
|---|---|---|---|
| 5-196325 | 8/1993 | Japan | 62/509 |

*Primary Examiner*—Harry B. Tanner

*Attorney, Agent, or Firm*—James M. Ritchey

[57] ABSTRACT

For use with a heat exchange system having a compressor, condenser, evaporator, expansion device, and circulating refrigerant, an efficiency enhancing apparatus. Comprising the apparatus is a liquid refrigerant containing vessel having a refrigerant entrance and a refrigerant exit with the vessel positioned in the heat exchange system between the condenser and the evaporator. Included are means associated with said vessel for creating a turbulent flow of liquefied refrigerant.

19 Claims, 5 Drawing Sheets

REFRIGERANT SYSTEM EFFICIENCY AMPLIFYING APPARATUS

BACKGROUND OF THE INVENTION

1. Field of the Invention

For efficiency amplification, a refrigerant-side control for condensers on air condition or refrigeration systems is disclosed. More specifically, by relying on principles of fluid mechanics and turbulent flow of a refrigerant, the subject apparatus achieves maximum refrigerant operational conditions while reducing energy consumption by the system.

2. Description of the Background Art

Various devices relying on standard refrigerant recycling technologies have been available for many years. Refrigeration and heat pump devices, having both cooling and heating capabilities, are included within the general scheme of the subject invention, however, the subject device relates preferably to refrigeration systems. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

Traditional sub-coolers partially cool the refrigerant prior to the expansion device and subsequent evaporator. Such refrigerant cooling has been shown to increase the efficiency of the heat transfer within the evaporator. Various types of sub-coolers exist, but the most common form cools the refrigerant by drawing in cooler liquid to surround the warmer refrigerant.

SUMMARY OF THE INVENTION

An object of the present invention is to disclose a refrigerant system efficiency amplifying apparatus.

Another object of the present invention is to describe an apparatus that decreases the amount of energy required to power a compressor in a refrigeration of heat pump system.

A further object of the present invention is to relate an apparatus that decrease the compression ratio for a compressor in a refrigeration of heat pump system, thereby increasing the efficiency and economy of the system.

Still another object of the present invention is to produce an apparatus that introduces turbulent flow into the liquefied refrigerant within a refrigeration or heat pump system, thus increasing the operational conditions for the refrigerant that favor enhancing efficiency of the system.

Yet a further object of the present invention is to disclose a turbulence producing device that is located in a stream of liquefied refrigerant that comprises a disk with a central aperture that permits the passage of refrigerant and a set of fixed angled blades formed in the disk that project into the central aperture.

Disclosed for use with a heat exchange system (refrigeration or heat pump devices) having at least a compressor, condenser, evaporator, expansion device, and circulating refrigerant, is an efficiency enhancing apparatus comprising a liquid refrigerant containing vessel formed from a cylinder capped by a top end cap and a bottom end cap, wherein the vessel is positioned in the heat exchange system between the condenser and the evaporator. A refrigerant entrance is located in a top region of the vessel and a refrigerant exit is located in a bottom region of the vessel. Preferably, the refrigerant exit is positioned to be no lower than approximately a lowest point in the condenser.

Provided are first means for generating turbulence in the refrigerant associated with the top region and second means for generating turbulence in the refrigerant associated with the bottom region. Preferably, the first means comprises means for generating a rotational motion of the entering refrigerant within the vessel. The second means comprises a set of fixed angle blades positioned in the bottom region of the vessel. The set of blades produces turbulence in the refrigerant as the refrigerant exits the vessel. More particularly, the second means comprises a disk located proximate the refrigerant exit, a central aperture formed in the disk that permits the passage of exiting refrigerant, and a set of fixed angled blades formed in the disk that project into the central aperture, wherein the set of blades adds turbulence to the exiting refrigerant.

Other objects, advantages, and novel features of the present invention will become apparent from the detailed description that follows, when considered in conjunction with the associated drawings.

DESCRIPTION OF THE PREFERRED EMBODIMENT

Before a detailed description of the subject invention is presented, a rationale for the subject systems amplification of efficiency is presented. Also, it must be noted that even though a refrigeration system is utilized in the figures and detailed description of the subject invention, any heat pump system can be fitted or adapted with the subject device.

Figure 1:
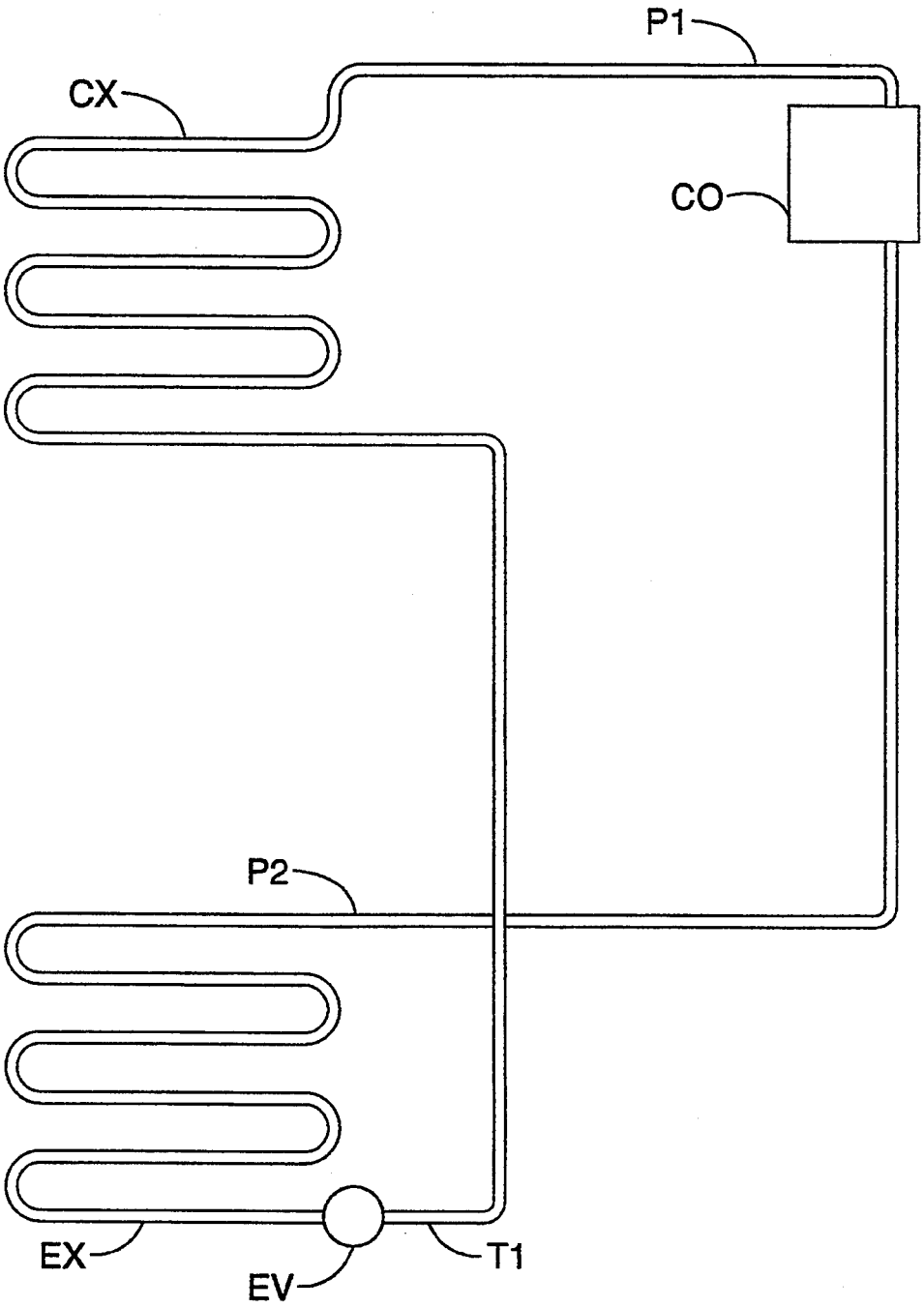
PRIOR ART FIG. – 1
FIG. 1 is a schematic view of a traditional or "Prior Art" refrigeration system.

Referring now to FIG. 1 for a generalized "Prior Art" refrigeration system, to quickly appreciate the benefits of the subject device, a brief description of the functioning of a traditional refrigeration system is supplied. An expandable-compressible refrigerant (no refrigerant has been found that has not worked successfully with the subject device) is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. As indicated, even though the subject invention is used preferably with a refrigeration system, adaptation to a generalized heat pump system is considered to be within the realm of this disclosure. Therefore, for a heat pump, heating or cooling conditions are generated in the first and second environments by reversing the process within the enclosed system.

As indicated, FIG. 1 depicts a traditional refrigeration system, but, again, it must be stressed that the subject invention is suitable for modifying any equivalent heat pumps systems in an analogous manner. The four basic components in all systems are: a compressor CO; a condenser (heat exchanger) CX; an evaporator (heat exchanger) EX; an expansion valve EV; and the necessary plumbing to connect the components. These components are the same regardless of the size of the system. Gaseous refrigerant is compressed by the compressor CO and transported to the condenser CX which causes the gaseous refrigerant to liquefy. The liquid refrigerant is transported to the expansion valve EV and permitted to expand gradually into the evaporator EX. After evaporating into its gaseous form, the gaseous refrigerant is moved to the compressor CO to repeat the cycle.

A lower compression ratio reflects a higher system efficiency and consumes less energy during operation. During compression the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. The higher the gas temperature/pressure on the condenser side of the compressor, the greater the compression ratio. The greater the compression ratio the higher the energy consumption. Further, the energy (Kw) necessary to operate a cooling or heat exchange system is primarily determined by three factors: the compressor's compression ratio; the refrigerant's condensing temperature; and the refrigerant's flow characteristics.

The compression ratio is determined by dividing the discharge pressure (head) by the suction pressure. Any change in either suction or discharge pressure will change the compression ratio.

It is noted that for refrigeration systems or any heat pump systems when pressure calculations are performed they are often made employing absolute pressure units (PSIA), however, since most individuals skilled in the art of heat pump technologies are more familiar with gauge pressure (PSIG), gauge pressures are used as the primary pressure units in the following exemplary calculations. In the traditional refrigeration system shown in FIG. 1, a typical discharge pressure of 226 PSIG (241 PSIA) is found at P1 and a typical suction pressure of 68 PSIG (83 PSIA) is measured at P2. Dividing 226 PSIG by 68 PSIG yields a compression ratio of about 2.9.

The condensing temperature is the temperature at which the refrigerant gas will condense to a liquid, at a given pressure. Well known standard tables relate this data. In the FIG. 1 traditional example, using R22 refrigerant, that pressure is 226 PSIG. This produces a condensing temperature of 110° F. at T1. At 110° F., each pound of liquid freon that passes into the evaporator will absorb 70.052 Btu's. However, at 90° F. each pound of freon will absorb 75.461 Btu's. Thus, the lower the temperature of the liquid refrigerant entering the evaporator the greater its ability to absorb heat. Each degree that the liquid refrigerant is lowered increases the capacity of the system by about one-half percent.

Well known standard tables of data that relate the temperature of a liquid refrigerant to the power required to move Btu's per hour show that if the liquid refrigerant is at 120° F., 0.98 hp will move 22873 Btu's per hour. If the liquid refrigerant is cooled to 60° F., only 0.2 hp is required to move 29563 Btu's per hour.

Additionally, Refrigerant flow through the refrigerant system, in most heat pump systems, is laminar flow. Traditional systems are designed with this flow in mind. However, a turbulent flow is much more energy efficient as known from well established data tables.

Figure 2:
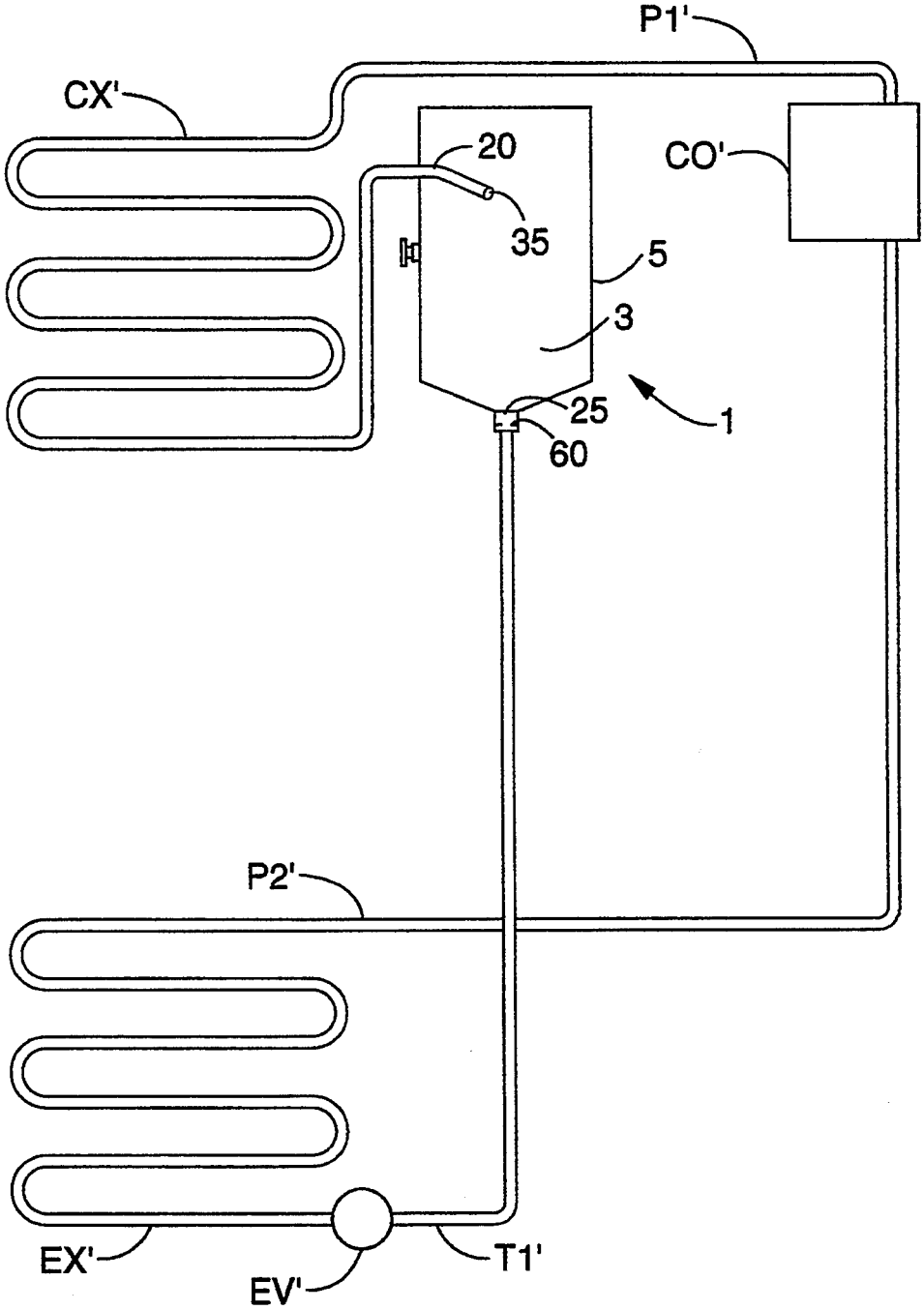
FIG. 2 is a schematic view of a refrigeration system adapted with the subject invention.

Referring now to FIG. 2, there is shown a preferred embodiment of the subject device 1 fitted into a traditional refrigeration system. The primes denote equivalent features (CO′=compressor; CX′=condenser; EX′=evaporator; and EV′=expansion valve), but with the subject invention fitted into the system between the condenser CX′ and the evaporator EX′. The subject system stores excess liquid refrigerant (that is normally stored in the condenser) in a holding vessel 3, thus giving an increased condensing volume (usually approximately 20% more condensing volume), thereby cooling the refrigerant more (a type of sub-cooling). By adding this extra cooling the subject system reduces the discharge pressure and suction pressure. For discharge at P1′ the pressure is 168 PSIG (183 PSIA) and for suction at P2′ the pressure is 60 PSIG (74 PSIA). With these discharge and suction pressures, the compression ratio calculates to be 2.5. For the traditional refrigeration system shown in FIG. 1, the previously calculated compression ratio was 2.9. This shows a reduction in compression work of about 17%.

Concerning the condensing temperature for the subject adapted system, the liquid refrigerant temperature at T1′ is about 90° F. (lowered from the 110° F. T1 noted above for the traditional system). The 20° F. drop in liquid refrigerant temperature yields a 10% increase in system capacity (20° F. times one-half percent for each degree, as indicated above). This was accomplished by the increased condensing volume provided by the subject device.

The subject invention influences the flow of the liquid refrigerant. Normally, when a vessel is introduced into a fixed pressure system (usually, for sub-cooling) a reduction in the system's capacity occurs because most fixed head pressure systems utilize a fixed orifice or capillary type expansion device. Such devices require pressure to force a proper volume of refrigerant through them in order to maintain capacity. The pressure is generated by the compressor. The greater the demand for pressure the greater the demand for energy (Kw).

With the adaptation of a fixed head pressure heat pump system by the subject device, the capacity is maintained. The capacity is maintained due to increased refrigerant velocity, volume, and refrigerant Btu capacity because of lower condensing temperature and an introduced spiral turbulent flow, rather than a straight laminar flow. As is well know in fluid dynamics, turbulent flow has an average velocity that is far more uniform than that for laminar flow. In fact, far from being a parabola, as in laminar flow, the distribution curve of the boundary region for a flowing liquid with turbulent flow is practically logarithmic in form. Thus, for turbulent motion, at the boundaries where the eddy motion must reduce to a minimum, the velocity gradient is much higher than in laminar type flow. With the subject device and its influence on refrigerant flow, the hotter the condensing temperature and the higher the load, the better the adapted system functions.

Figure 3:
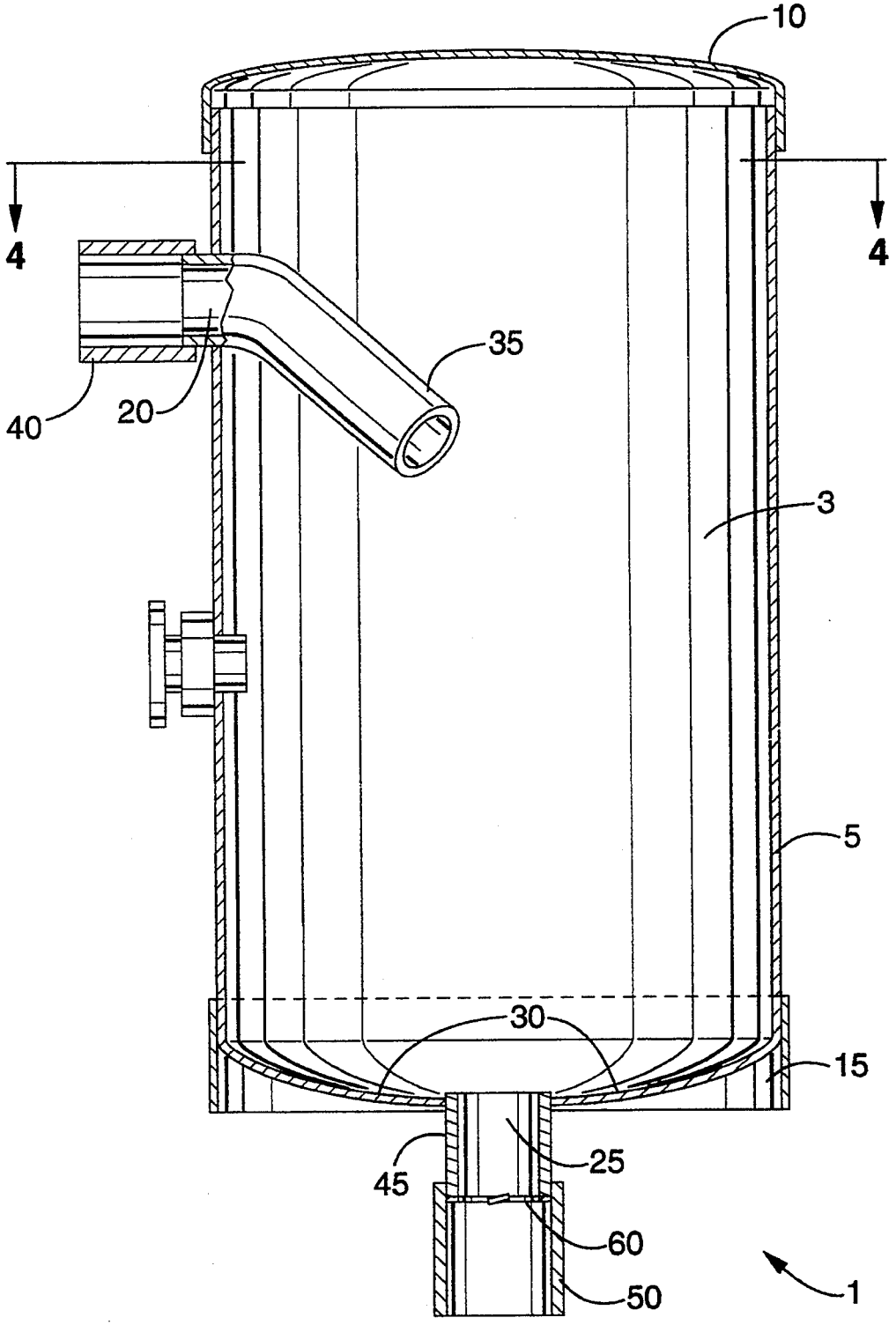
FIG. 3 is a cross-sectional view of the subject unit.

As seen in FIG. 3, in particular, the subject invention comprises a vessel 1 with an internal volume 3 and fabricated usually from a cylinder 5 and top 10 and bottom 15 end caps of suitable material such a metal, metal alloy, or natural or synthetic polymers. Generally, the top 10 and bottom 15 end caps are secured to the cylinder 5 by appropriate means such as soldering, welding, brazing, gluing, threading and the like, however, the entire vessel 1 may be formed from a single unit with the cylinder 5 and top 10 and bottom end caps as a unitized construction.

A liquid refrigerant entrance 20 and a liquid refrigerant exit 25 penetrate the vessel 1. Preferably, the refrigerant entrance 20 is located in a top region of the vessel 1. The top region is defined as being approximately between a midline of the cylinder 5, bisecting the cylinder 5 into two smaller cylinders, and the top end cap 10. Although FIG. 3 depicts the refrigerant entrance 20 as penetrating the cylinder 5, the entrance may penetrate the top end cap 10. Preferably, the refrigerant exit 25 is located in a bottom region of the vessel 1. The bottom region of the vessel 1 is defined as being approximately between the midline, above, and the bottom end cap 15. Although other locations are possible, the refrigerant exit 25 is preferably located proximate the center of the bottom end cap 15.

Usually, the bottom end cap 15 has an angled or sloping interior surface 30. However, the bottom end cap 15 may have an interior surface of other suitable configurations, including being flat.

Liquid refrigerant liquefied by the condenser CX′ enters into the vessel 1 via the refrigerant entrance 20 and the associated components. The associated entrance components comprise a refrigerant delivery tube 35 and entrance fitting 40 that secures the vessel 1 into the exit portion of the plumbing coming from the condenser CX′. The entrance fitting 40 is any suitable means that couples the subject device into the plumbing in the required position between the condenser CX′ and the evaporator EX′.

Figure 4:
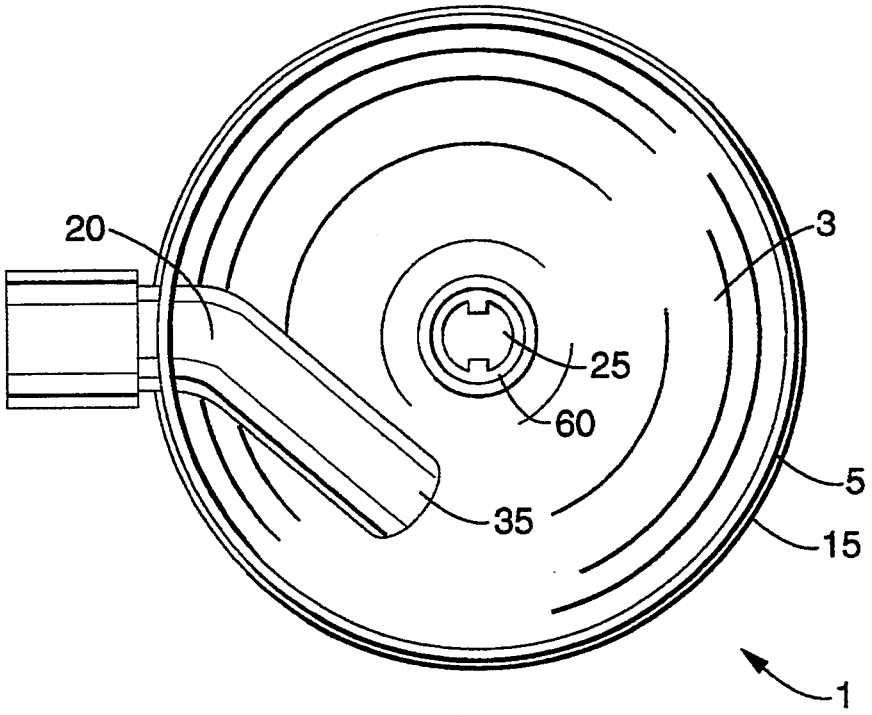
FIG. 4 is a cross-sectional view of the subject unit taken along line 4—4 in FIG. 3.

The refrigerant delivery tube 35 is configured to generate rotational motion in the entering refrigerant. The tube 35 penetrates into the top region and is formed into a curved configuration and generally angled down to deliver the entering refrigerant along a path suitable for generating a rotational motion of the refrigerant within the vessel 1 (as seen in FIG. 4). Other equivalent configuration of the tube 35 that generate such a rotational refrigerant motion are contemplated to be within the realm of this disclosure.

To view the level of the liquid refrigerant within the vessel 1, a sight glass 45 is provided. The glass 45 is mounted is the cylinder 5 at a position to note the refrigerant level.

The refrigerant exit 25 is comprised of an exit tube 45 and a fitting 50 that secures the subject device into the plumbing of the system. The exit fitting 50 is any suitable means that couples the subject device into the plumbing in the required position between the condenser CX′ and the evaporator EX′.

Figure 5:
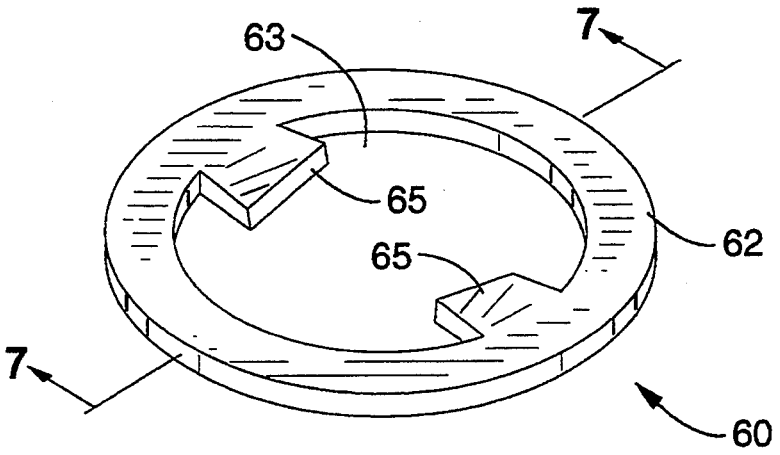
FIG. 5 is a perspective view of the "turbulator" of the subject invention.
Figure 6:
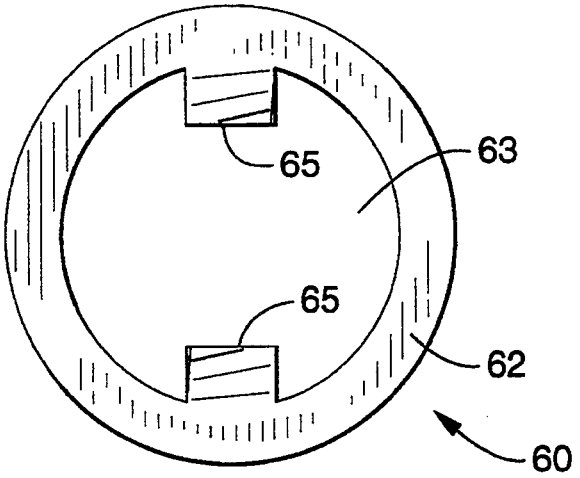
FIG. 6 is top view of the "turbulator" of the subject invention.
Figure 7:
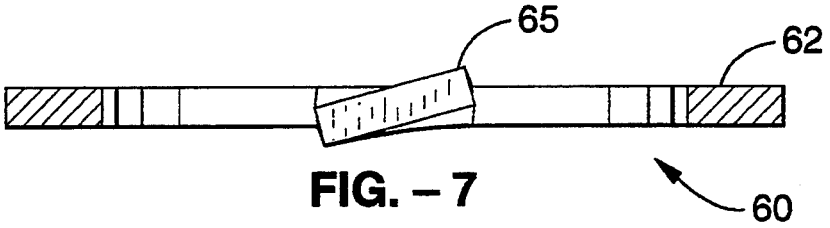
FIG. 7 is cross-sectional view of the "turbulator" of the subject invention taken alone line 7—7 in FIG. 6.

Additionally, a second means for introducing a turbulent flow into the exiting liquefied refrigerant is mounted proximate the exit 25. A "turbulator" 60 is held in place by cooperation between the exit tube 45 and the exit fitting 50 or any other equivalent means. The turbulator is usually a separate component that is secured within the components of the exit from the vessel 1, however, the turbulator may be an integral part of the vessel 1 refrigerant exit. As clearly seen in FIGS. 5–7, the turbulator comprises a disk 62 with a central aperture 63 and at least one fixed angle blade 65 formed or cut into the disk 62. Preferably, a set of fixed angle blades 65 are provided to add turbulence to the exiting refrigerant (two blades 65 are depicted in the figures, but more than two blades 65 are possible).

The blades 65 are angled to induce rotational, turbulent motion of the liquid refrigerant and the refrigerant exits the vessel 1. Various angles for the blades 65 are suitable for generating the required turbulence.

Preferably, the subject vessel 1 is placed in the adapted system so that the refrigerant exit 25 is no lower than the lowest portion of the condenser CX′. Liquid refrigerant from the condenser CX′ enters the vessel 1 and is directed into a swirling motion about the interior volume 3 by the delivery tube 35. The swirling liquid refrigerant leaves the vessel 1 by means of the refrigerant exit 25 and then encounters the turbulator 60. The blades 65 of the turbulator 60 add additional turbulence into the flow of the refrigerant.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use with a heat exchange system having a compressor, condenser, evaporator, expansion device, and circulating refrigerant, an efficiency enhancing apparatus comprising:

a) a liquid refrigerant containing vessel having a refrigerant entrance and a refrigerant exit, wherein said vessel is positioned in the heat exchange system between the condenser and the evaporator and b) means associated with said vessel for creating a turbulent flow of liquefied refrigerant.

2. An apparatus according to claim 1, wherein said turbulence creating means comprises at least one fixed angle blade positioned proximate said refrigerant exit in said vessel, wherein said blade produces turbulence in said refrigerant as said refrigerant exits said vessel.

3. An apparatus according to claim 1, wherein said turbulence creating means comprises:

a) a disk located proximate said refrigerant exit;

b) a central aperture formed in said disk that permits the passage of exiting refrigerant;

c) a set of fixed angled blades formed in said disk that project into said central aperture, wherein said set of blades adds said turbulence to said exiting refrigerant.

4. An apparatus according to claim 1, wherein said turbulence creating means further comprises:

a) first means for generating turbulence in the refrigerant as the refrigerant enters said vessel and b) second means for generating turbulence in the refrigerant as the refrigerant exits said vessel.

5. An apparatus according to claim 4, wherein said first means comprises means for generating a rotational motion of the entering refrigerant within said vessel.

6. An apparatus according to claim 5, wherein said rotational motion means comprises a tube formed to deliver the entering refrigerant along a path suitable for generating said rotational motion within said vessel.

7. An apparatus according to claim 4, wherein said second means comprises at least one fixed angle blade positioned proximate said refrigerant exit in said vessel, wherein said blade produces turbulence in said refrigerant as said refrigerant exits said vessel.

8. An apparatus according to claim 5, wherein said second means comprises at least one fixed angle blade positioned proximate said refrigerant exit in said vessel, wherein said blade produces additional turbulence in said rotating refrigerant as said rotating refrigerant exits said vessel.

9. For use with a heat exchange system having a compressor, condenser, evaporator, expansion device, and circulating refrigerant, an efficiency enhancing apparatus comprising:

a) a generally cylindrical liquid refrigerant containing vessel with a top region having a refrigerant entrance and a bottom region with a refrigerant exit, wherein said vessel is positioned in the heat exchange system between the condenser and the evaporator;

b) first means for generating turbulence in the refrigerant associated with said top region; and c) second means for generating turbulence in the refrigerant associated with said bottom region.

10. An apparatus according to claim 9, wherein said first means comprises means for generating a rotational motion of the entering refrigerant within said vessel.

11. An apparatus according to claim 10, wherein said rotational motion means comprises a tube penetrating into said top region and formed to deliver the entering refrigerant along a path suitable for generating said rotational motion within said vessel.

12. An apparatus according to claim 9, wherein said second means comprises a set of fixed angle blades positioned in said bottom region of said vessel, wherein said set of blades produces turbulence in said refrigerant as said refrigerant exits said vessel.

13. An apparatus according to claim 10, wherein said second means comprises a set of fixed angle blades positioned proximate said refrigerant exit in said vessel, wherein said set of blades produces additional turbulence in said rotating refrigerant as said rotating refrigerant exits said vessel.

14. For use with a heat exchange system having a compressor, condenser, evaporator, expansion device, and circulating refrigerant, an efficiency enhancing apparatus comprising:

a) a liquid refrigerant containing vessel formed from a cylinder capped by a top end cap and a bottom end cap, wherein said vessel is positioned in the heat exchange system between the condenser and the evaporator;

b) a refrigerant entrance located in a top region of said vessel;

c) a refrigerant exit located in a bottom region of said vessel, wherein said refrigerant exit is positioned to be no lower than approximately a lowest point in said condenser;

d) first means for generating turbulence in the refrigerant associated with said top region; and e) second means for generating turbulence in the refrigerant associated with said bottom region.

15. An apparatus according to claim 14, wherein said first means comprises means for generating a rotational motion of the entering refrigerant within said vessel.

16. An apparatus according to claim 15, wherein said rotational motion means comprises a tube penetrating into said top region and formed into a curved configurations to deliver the entering refrigerant along a path suitable for generating said rotational motion within said vessel.

17. An apparatus according to claim 14, wherein said second means comprises a set of fixed angle blades positioned in said bottom region of said vessel, wherein said set of blades produces turbulence in said refrigerant as said refrigerant exits said vessel.

18. An apparatus according to claim 16, wherein said second means comprises a set of fixed angle blades positioned proximate said refrigerant exit in said vessel, wherein said set of blades produces additional turbulence in said rotating refrigerant as said rotating refrigerant exits said vessel.

19. An apparatus according to claim 14, wherein said second means comprises:

a) a disk located proximate said refrigerant exit;

b) a central aperture formed in said disk that permits the passage of exiting refrigerant;

c) a set of fixed angled blades formed in said disk that project into said central aperture, wherein said set of blades adds said turbulence to said exiting refrigerant.

* * * * *